United States Patent [19]

Ristow et al.

[11] Patent Number: 4,996,801

[45] Date of Patent: Mar. 5, 1991

[54] TERMINATION BAR AND SPLICE FOR RUBBERIZED ROOFING SHEETS

[76] Inventors: Delano H. Ristow, 10015 Steinthal Rd., Kiel, Wis. 53042; Daniel B. Ristow, 14341 Riverton Cir., Westminster, Calif. 92683

[21] Appl. No.: 458,584

[22] Filed: Dec. 29, 1989

[51] Int. Cl.[5] ..... E04D 1/36

[52] U.S. Cl. ..... 52/58; 52/60; 52/96; 52/273; 52/716

[58] Field of Search ..... 52/58, 96, 410, 273, 52/60, 66, 94, 58, 526, 59, 61, 62, 95, 716, 717, 718, 287, 726

[56] References Cited

U.S. PATENT DOCUMENTS

| | | | |
|---|---|---|---|
| 1,740,753 | 12/1929 | Vallas | 52/58 |
| 2,487,571 | 11/1949 | Maxwell | 52/273 X |
| 4,335,546 | 6/1982 | Kelly | 52/58 |
| 4,534,147 | 8/1985 | Cristell | 52/287 |
| 4,648,218 | 3/1987 | Butzen | 52/96 |
| 4,912,900 | 4/1990 | Yeamanns | 52/60 X |

*Primary Examiner*—David A. Scherbel
*Assistant Examiner*—Creighton Smith
*Attorney, Agent, or Firm*—Foley & Lardner

[57] ABSTRACT

A termination bar assembly for securing the edges of a rubberized sheathing member covering a supporting roof structure to the vertical walls surrounding the supporting roof structure, the assembly including a number of elongate strips having a flat center section and tubular edges, a series of openings in the center section, a number of screws passing through the openings and the sheathing member for securing said strip to the vertical wall and a splice clip having a center section and circular tubes along the edges of the center section from matingly engaging the tubular edges of the elongate strips, a raised tab is provided in the center section to center the ends of the elongate strips on the clip.

7 Claims, 2 Drawing Sheets

TERMINATION BAR AND SPLICE FOR RUBBERIZED ROOFING SHEETS

BACKGROUND OF THE INVENTION

1. Field of the Invention

This invention relates to termination bars for sealing the edges of rubberized roofing sheets and, more particularly to a system for mounting of the termination bars on the edges of the roofing sheets and to a splice clip for joining the ends of the termination bars.

2. Description of the Prior Art

Rubberized roofing materials have become popular in covering commercial buildings having flat roof supporting surfaces. These materials are formed into sheathing members which are long lasting and easily applied to large flat surface areas. The sheathing members are normally laid over a supporting surface with the edges secured to the vertical walls around the edges of the supporting surface. The rubberized sheathing members generally have an adhesive material on the backside which is activated for securing the edge of the sheathing member to the vertical walls. It has been found, however, that over a period of time water, which runs down the vertical walls of the building, gradually works its way into the space behind the edges of the sheathing members. As the water accumulates under the sheathing member, it will eventually leak through the supporting surface into the building. Repair or replacement of the supporting surface and water damaged areas of the building can be time consuming and costly, particularly where water leakage has occurred for a long period of time.

SUMMARY OF THE INVENTION

The present invention relates to an apparatus and system for sealing the edges of a sheathing member to the walls surrounding the edges of the roof supporting surfaces. This has been accomplished by mounting a number of termination bars in an end-to-end relationship to form a continuous seal between the edge of the sheathing member and the vertical wall. The seal is protected by a strip of sheathing material which is secured to the vertical wall in a position to overlay the termination bars. A second row of termination bars is mounted in an end-to-end relationship along the edge of the strip of sheathing material to seal the material to the wall.

Each of the termination bars is formed from an elongate strip of metal having a center section and integrally formed tubular edges. The ends of the termination bars are joined by a splice clip which interengages with the ends of the adjacent termination bars. The splice clip includes a center section having a raised tab in the middle of the center section and a pair of circular tubes along the edges of the center section. The tubular edges of the termination bars are inserted into the open ends of the circular tubes of the splice clip with the ends of the termination bar in abutting relationship to the tab in the clip. With this arrangement, the edges of the termination bars and the splice clips provide a continuous double seal between the edge of the strip of sheathing material and the vertical wall.

A primary advantage of the present invention is the method of mounting the termination bars on the edge of the sheathing member and in an end-to-end relationship.

One of the primary features of the present invention is the provision of a positive double seal between the edge of the sheathing member and the wall.

Another feature of the present invention is the provision of a continuous seal along the edge of the rubberized sheathing member by the inclusion of a splice clip to connect the ends of the adjacent termination bars. This construction is simpler than known constructions and provides a more effective seal arrangement for sealing the edges of the sheathing members.

Another innovative feature of the invention is the provision for additional water protection for the termination bars by the addition of a secondary strip of sheathing material which overlies the termination bars and is also sealed to the wall above the sealed edge of sheathing member.

Other principal features and advantages of the invention will become apparent to those skilled in the art upon review of the following detailed description, claims and drawings.

DETAILED DESCRIPTION OF THE DRAWINGS

FIG. 1 a perspective view of a portion of a roof structure showing the termination bars and a splice clip secured to the edge of the rubberized sheathing member.

Figure 1:
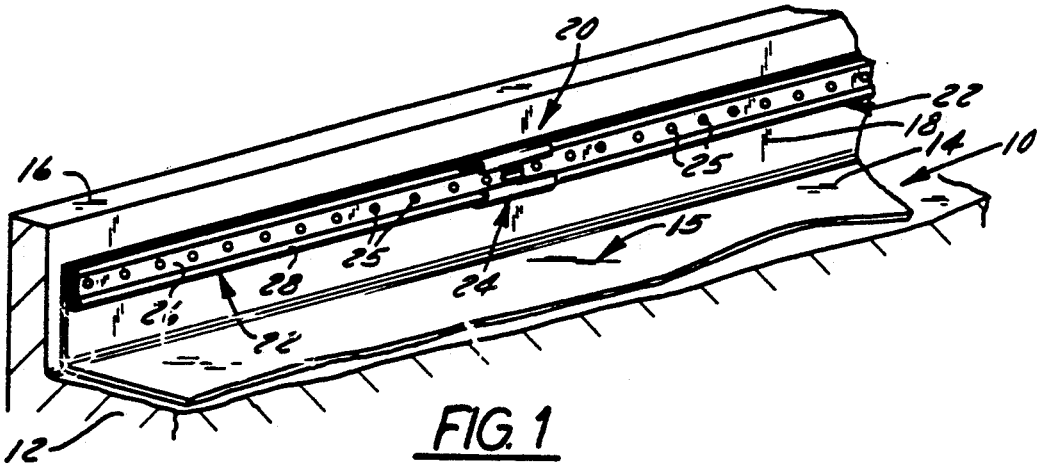
Figure 3:
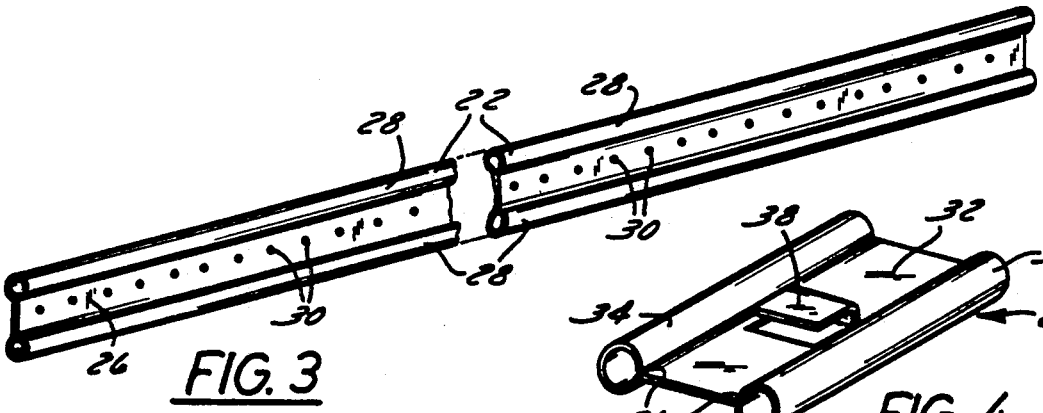
FIG. 3 is a perspective view of a termination bar.
Figure 4:
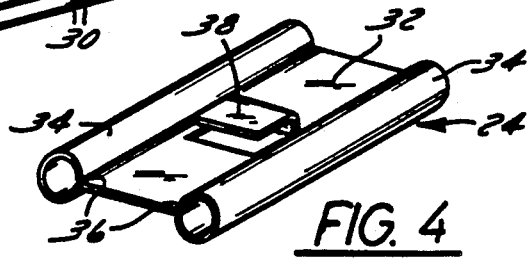
FIG. 4 is a perspective view of the splice clip.
Figure 5:
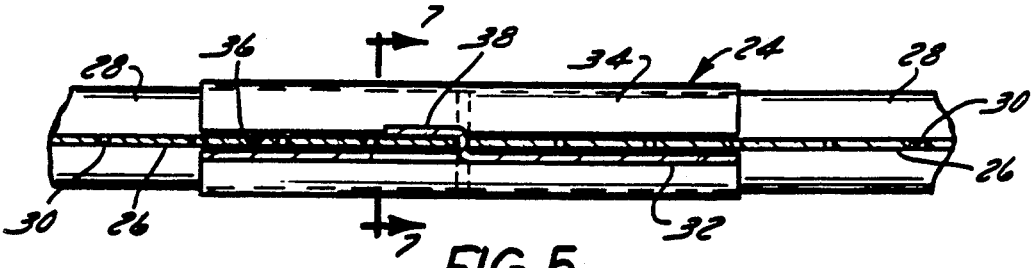
FIG. 5 is a sectional side elevation view of the ends of the termination bars shown positioned in the splice clip.
Figure 6:
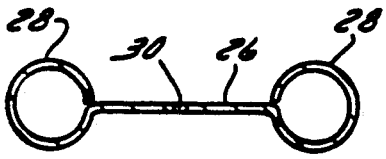
FIG. 6 is an end view of a termination bar.
Figure 7:
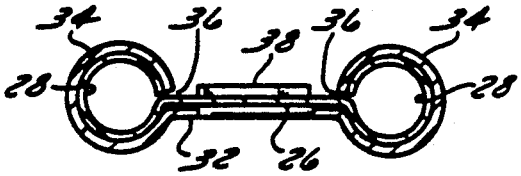
FIG. 7 is a cross sectional view taken on line 7—7 of FIG. 5 showing the termination bar inserted into the splice clip.

Before explaining at least one embodiment of the invention in detail, it is to be understood that the invention is not limited in its application to the details of construction and the arrangement of the components set forth in the following description or illustrated in the drawings. The invention is capable of other embodiments or of being practiced or carried out in various ways. Also, it is to be understood, that the phraseology and terminology employed herein is for the purposes of description and should not be regarded as limiting.

DETAILED DESCRIPTION OF THE PREFERRED EMBODIMENTS

This invention relates to a termination bar assembly 20 for sealing a sheathing member 15 to form a waterproof roof 10 for a flat roof structure 12 and more particularly to a system for sealing the edges of the roof sheathing member 15 to the vertical walls 16. The roof 10 generally includes a continuous, elastic sheathing member 14 which overlies the flat roof structure 12 and terminates at one or more vertical wall 16. The edge 18 of the sheathing member 14 is generally adhesively secured to the surface of the vertical wall 16. In accordance with the present invention, the termination bar assembly 20 is mounted on the vertical wall 16 to provide a positive double seal between the vertical wall and the edge 18 of the sheathing member 14.

In this regard, the termination bar assembly 20 includes one or more termination bars 22 which are connected at their ends by means of a splice clip 24 to form a continuous strip. The termination bars 22 are secured to the vertical wall 16 by means of nails or screws 25 which pass through the termination bars and the edge 18 of the sheathing member 14 to lock the edge to the vertical wall.

Each termination bar 22 is in the form of an extrusion having a center section 26 and a pair of tubular edges 28. A series of holes 30 are provided along the center section 26 for mounting each termination bar on the vertical wall 16.

Figure 2:
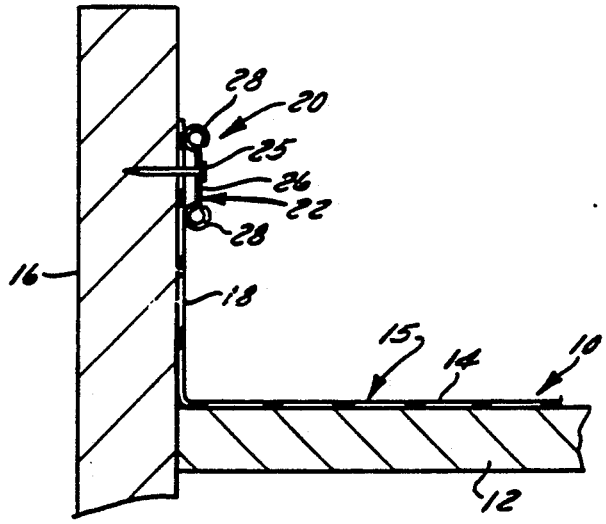
FIG. 2 is a cross sectional view of the roof structure shown in FIG. 1 showing the termination bars mounted on the upper edge of the sheathing member.
Figure 10:
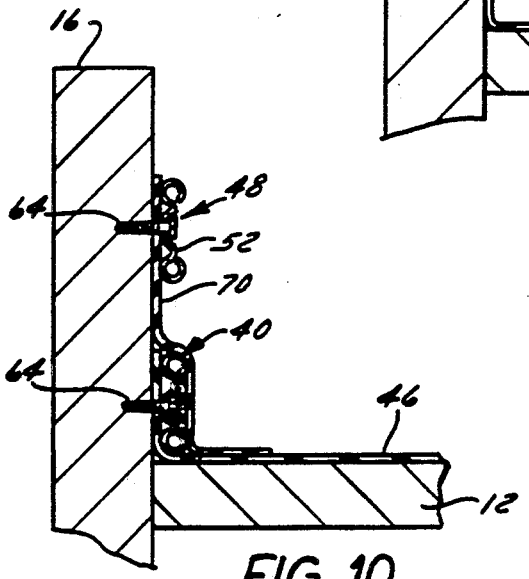
FIG. 10 is a cross sectional view of a modified splice clip.

As noted in FIG. 2, when the termination bar 22 is mounted on the wall, each of the tubular edges 28 will provide a line contact between the sheathing member and the wall by the abutting engagement of the tubular members with the sheathing member.

The ends of the termination bars are connected by means of the splice clip 24 to provide a continuation of the line of contact of the termination bars and the edge of the sheathing member. The splice clip includes a center section 32 with the edges 34 formed in a semi-circular tubular configuration which provides a gap 36 between the end of the semi-circular sections 34 and the center section 32 of the clip. A tab or stop 38 is provided in the middle of the center section 32 which forms an abutment in the center of the clip in order to center the clip on the ends of the termination bars.

Termination bars 22 are mounted on the rubberized sheathing member after the sheathing member has been adhesively secured to the walls 16. The termination bars are aligned with the upper edge of the sheathing member and secured in position by nails or screws 25. The splice clip 24 is mounted on one end of the termination bar with the tubular edges 28 aligned in the tubular edges 34 and the center section matingly engaging the tab 38. The next termination bar is then inserted into the other side of the splice clip 24 until it engages the tab 38 and is then nailed into position on the edge of the sheathing member 14.

Figure 9:
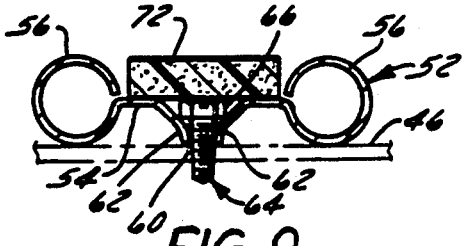
FIG. 9 is a cross sectional view of an alternate arrangement for sealing the edges of a rubberized sheathing member.
Figure 8:
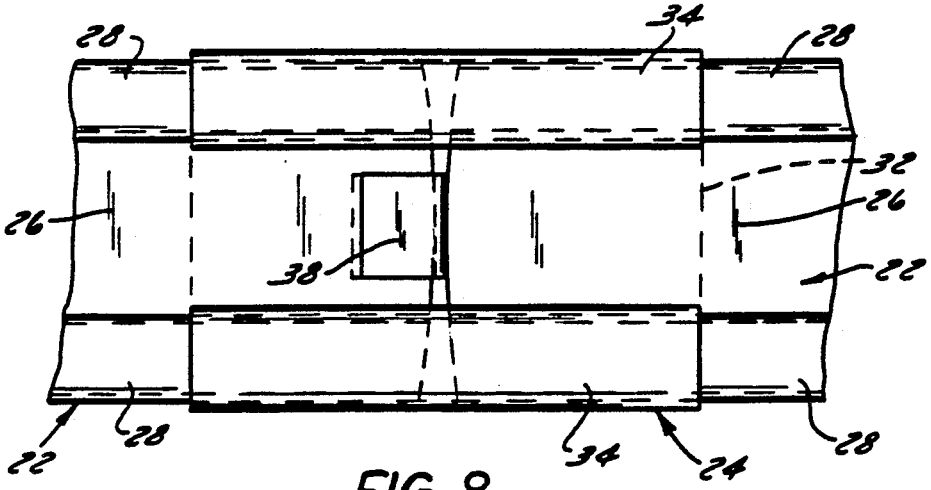
FIG. 8 is a view of the splice clip mounted on the ends of the termination bar.

Referring to FIG. 9, an alternate form of termination bar 52 is shown. The termination bar 52 includes a center section 54, having tubular edges 56. The center section 54 is located in a spaced relation to the sheathing member 46 midway between the tubular edges 56. Means are provided for preventing bowing inward of the center section 54 when secured to the vertical walls. Such means is in the form of a number of pierced openings 60 provided in the center section 54 with the edges 62 of each opening 60 bent far enough to engage the sheathing member 46 when the edges 56 of the termination bars are seated on the sheathing member 46. Threaded screws 64 having hexagonal heads 66 are used to mount the termination bars on the wall. When the primary termination bars 52 are secured to the wall 16, the heads 66 of the screws 64 will force the edges 62 of the pierced openings 60 into engagement with the sheathing material 46 preventing bowing of the center section 54.

The primary termination bar assembly 40 can be further protected from exposure to water damage by securing a strip 70 of the sheathing member to the wall 16 above the primary termination bar assembly 40, so that the strip 70 overhangs the primary termination bar assembly 40. The strip 70 is secured to the wall 16 by an adhesive provided on the back of strip 70. The strip 70 is sealed to the wall 16 by means of a secondary termination bar assembly 48 which is formed from termination bars 52. The termination bars 52 are secured to the vertical wall 16 by screws 64 to seal the upper edge of the strip to the wall. The center section 54 of the termination bar 52 of the primary termination bar assembly 40 can be provided with a self-adhesive tape 72 to fill the space between the tubular members 56. The portion of strip 70 which overlies the tape 72 can be adhesively secured to the tape 7.

Thus, it should be apparent that there has been provided, in accordance with the present invention, a termination bar assembly for a rubberized roofing sheet that fully satisfies the aims and advantages set forth above. Although the invention has been described in conjunction with specific embodiments thereof, it is evident that many alternatives, modifications, and variations will be apparent to those skilled in the art. Accordingly, it is intended to embrace all such alternatives, modifications and variations as fall within the spirit and broad scope of the appended claims.

The embodiments of the invention in which an exclusive property or privilege is claimed are defined as follows:

1. A termination bar assembly for securing the edges of a rubberized sheathing member covering a supporting roof structure to the vertical walls around the supporting roof structure, said assembly comprising:

a number of elongate strips of metallic material, each strip having a flat center section and tubular edges, said center section having a series of openings;

means passing through said openings and said sheathing member for securing said strip to the vertical wall, and a splice clip for connecting the ends of the adjacent strips, said splice clip having a center section and circular tubes along each edge of said center section for matingly engaging the tubular edges of said elongate strips and further including a raised tab in said center section to center the ends of said elongate strips on said clip.

2. The assembly according to claim 1 wherein said openings are provided with pierced edges to prevent bowing of said center section when said securing means is attached to the wall.

3. The assembly according to claim 2 wherein said securing means comprises a screw having an enlarged head for bending said pierced edges into engagement with said sheathing member.

4. A termination bar assembly for sealing the edges of a sheathing member for a roof structure to a vertical wall, said assembly including:

a plurality of termination bars each having a flat center section and tubular edges along each side of said center section; and a splice clip having a flat center section and circular edges along each side of said center section;

said circular edges terminating short of said flat center section whereby said splice clip can be telescoped onto the ends of said termination bars.

5. A system for securing the edges of a rubberized sheathing material to the vertical walls around the edges of a supporting roof structure, said system comprising:

a primary termination bar assembly for sealing the edge of the rubberized sheathing material to the vertical wall at the intersection of the vertical wall with the supporting roof structure, a strip of rubberized sheathing material overlying said primary transition, bar assembly, and a secondary termination bar assembly for sealing the edge of said strip of rubberized sheathing material to the vertical wall in an overhanging relation to said primary transition bar assembly.

6. The system according to claim 5 wherein said transition bar assemblies each include a plurality of elongate transition bars and a splice clip connecting the ends of said transition bars to form a continuous strip.

7. The system according to claim 6 wherein said transition bars each include a flat elongate center section and a tubular member formed along each edge of said center section, said splice clips each include a flat center section and a semi-circular member formed along each edge of said center section whereby said clips matingly engage said transition bars with said tubular members nested in said semi-circular members.

* * * * *